US009505227B2

(12) United States Patent
Nakao et al.

(10) Patent No.: US 9,505,227 B2
(45) Date of Patent: Nov. 29, 2016

(54) LIQUID EJECTING APPARATUS WITH WATER REPELLENT REGION

(71) Applicant: SEIKO EPSON CORPORATION, Tokyo (JP)

(72) Inventors: Hajime Nakao, Azumino-shi (JP); Nobuhiko Yamauchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 42 days.

(21) Appl. No.: 14/806,134

(22) Filed: Jul. 22, 2015

(65) Prior Publication Data

US 2016/0023464 A1 Jan. 28, 2016

(30) Foreign Application Priority Data

Jul. 23, 2014 (JP) ..... 2014-150222

(51) Int. Cl.

*B41J 2/175* (2006.01)
*B41J 2/14* (2006.01)
*B41J 2/16* (2006.01)

(52) U.S. Cl.

CPC ..... *B41J 2/17596* (2013.01); *B41J 2/1433* (2013.01); *B41J 2/162* (2013.01); *B41J 2/164* (2013.01); *B41J 2/175* (2013.01); *B41J 2/17509* (2013.01); *B41J 2/17523* (2013.01)

(58) Field of Classification Search

CPC B41J 2/17556; B41J 2/17596; B41J 2/1433; B41J 2/175; B41J 2/17523; B41J 2/17509; B41J 2/162; B41J 2/164

See application file for complete search history.

(56) References Cited

U.S. PATENT DOCUMENTS

2013/0161422 A1 6/2013 Miyajima et al.

FOREIGN PATENT DOCUMENTS

| | | | |
|---|---|---|---|
| JP | 2010-208048 A | | 9/2010 |
| JP | 2010-208048 A | * | 9/2010 |
| JP | 2011-051271 | | 3/2011 |
| JP | 2013-132894 A | | 7/2013 |

OTHER PUBLICATIONS

European Search Report for Application No. 15174616.1 dated Nov. 25, 2015.

* cited by examiner

*Primary Examiner* — Justin Seo
*Assistant Examiner* — Roger W Pisha, II
(74) *Attorney, Agent, or Firm* — Workman Nydegger

(57) ABSTRACT

A liquid ejecting apparatus includes a liquid ejecting head that includes a nozzle opening which ejects liquid and a valve unit that is connected to the liquid ejecting head and opens and closes a flow passage of the liquid, in which the valve unit includes a valve seat which is provided in the flow passage and a valve body which opens and closes the flow passage by coming into contact with or being separated from the valve seat, the valve seat includes a contacting member coming into contact with the valve body and a supporting member which supports the contacting member, the contacting member is assembled with the supporting member in a state in which the supporting member is subjected to a water repellent treatment more than the inner surface of the flow passage, and the valve body includes an elastic member coming into contact with the valve seat and a fixing member which fixes the elastic member.

4 Claims, 6 Drawing Sheets

LIQUID EJECTING APPARATUS WITH WATER REPELLENT REGION

CROSS-REFERENCE TO RELATED APPLICATIONS

The entire disclosure of Japanese Patent Application No: 2014-150222, filed Jul. 23, 2014 is expressly incorporated by reference herein in its entirety.

BACKGROUND

1. Technical Field

The present invention relates to a liquid ejecting apparatus including a liquid ejecting head which ejects liquid from a nozzle opening and a valve unit which supplies the liquid to the liquid ejecting head, and a manufacturing method thereof, and more particularly, to an ink jet recording apparatus which ejects ink as liquid and a manufacturing method thereof.

2. Related Art

In the liquid ejecting apparatus which ejects liquid to a medium to be recorded, for example, the ink jet recording apparatus which performs printing on paper or a recording sheet which is the medium to be recorded by ejecting ink as liquid has been known.

Such an ink jet recording apparatus is an apparatus in which the ink is supplied from a liquid storage unit such as an ink tank through a supply pipe such as a tube to the ink jet recording head, and the ink supplied from the ink tank is ejected from a nozzle opening of the ink jet recording head as ink droplets. In addition, the ink jet recording apparatus has been proposed in which a valve unit which is a pressure adjusting valve is provided in the middle of a flow passage so that the ink supplied from the liquid storage unit is supplied to the ink jet recording head with predetermined pressure (for example, refer to JP-A-2010-208048 and JP-A-2013-132894).

The valve unit includes a valve seat and a valve body. The valve unit closes the flow passage by bringing the valve seat into contact with the valve body, and opens the flow passage by separating the valve seat from the valve body. Opening and closing of the valve seat and valve body are performed by pressure of downstream of the flow passage.

In such a valve unit, the ink is accumulated by repeatedly bringing the valve seat into contact with the valve body so that a leak of the ink is generated. For this reason, by performing a water repellent treatment on a region in which the valve seat is brought into contact with the valve body, the accumulation of the ink can be suppressed.

However, since a part of the valve seat is not easy to be subjected to a water repellent treatment having high water repellent characteristic at a high accuracy, there is a concern that decrease of water repellency, a position deviation of the water repellent film subjected to the water repellent treatment, or the like is generated. Particularly, since the valve seat includes a complex shape in which concave and convent are formed, such a valve seat is not easy to be selectively subjected to the water repellent treatment at a high accuracy.

In addition, if the water repellent treatment is performed on regions other than a region where the valve seat is brought into contact with the valve body, particularly, the water repellent treatment is performed on an adhesive region, components constituting the flow passage cannot be sufficiently adhered to each other, there is a problem in that the ink is leaked from the flow passage, or the components are released from each other.

Moreover, such a problem not only exists in the ink jet recording apparatus, but also exists in the liquid ejecting apparatus which ejects liquid other than the ink.

SUMMARY

An advantage of some aspects of the invention is to provide a liquid ejecting apparatus which is capable of being selectively provided with a water repellent film having high water repellency at a high accuracy, suppressing a leak of the liquid by suppressing a liquid accumulation, and suppressing a leak of the liquid to the outside or a release of the components, and the manufacturing method thereof.

According to an aspect of the invention, there is provided a liquid ejecting apparatus including a liquid ejecting head that includes a nozzle opening which ejects liquid and a valve unit that is connected to the liquid ejecting head and opens and closes a flow passage of the liquid, in which the valve unit includes a valve seat which is provided in the flow passage and a valve body which opens and closes the flow passage by coming into contact with or being separated from the valve seat, the valve seat includes a contacting member coming into contact with the valve body and a supporting member which supports the contacting member, the contacting member is assembled with the supporting member in a state in which the supporting member is subjected to a water repellent treatment more than the inner surface of the flow passage, and the valve body includes an elastic member coming into contact with the valve seat and a fixing member which fixes the elastic member.

In this case, the supporting member is formed separately from the contacting member so that only the contacting member is capable of being subjected to a water repellent treatment. The water repellent treatment is sufficiently performed on the contacting member, and the valve body and the contacting member are repeatedly brought into contact with each other so that an accumulation of the liquid can be suppressed for a long time. In addition, a defect by a position deviation of the water repellent treatment, or the like can be suppressed.

It is preferable that the contacting member is formed of a metal material. According to this, swelling of the contacting member by the liquid is suppressed such that a leak of the liquid by seal deterioration due to the swelling can be suppressed.

In addition, it is preferable that the elastic member and the fixing member are formed by a two-color molding method. According to this, the position deviation of the elastic member with respect to the fixing member can be suppressed so that a sealing ability can be improved.

According to another aspect of the invention, there is provided a manufacturing method of a liquid ejecting apparatus which includes a liquid ejecting head that includes a nozzle opening which ejects liquid, and a valve unit that is connected to the liquid ejecting head and opens and closes a flow passage of the liquid, in which the valve unit includes a valve seat which is provided in the flow passage and a valve body which opens and closes the flow passage by coming into contact with or being separated from the valve seat, the valve seat includes a contacting member coming into contact with the valve body and a supporting member which supports the contacting member, and the valve body includes an elastic member coming into contact with the valve seat and a fixing member which fixes the elastic member. The method includes performing a water repellent treatment on the supporting member more than the inner surface of the flow passage and assembling the contacting member with the supporting member.

In this case, the supporting member is formed separately from the contacting member so that only the contacting member is capable of being subjected to a water repellent treatment. The water repellent treatment is sufficiently performed on the contacting member, and the valve body and the contacting member are repeatedly brought into contact with each other so that an accumulation of the liquid can be suppressed for a long time. In addition, a defect by a position deviation of the water repellent treatment, or the like can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

First Embodiment

Figure 1:
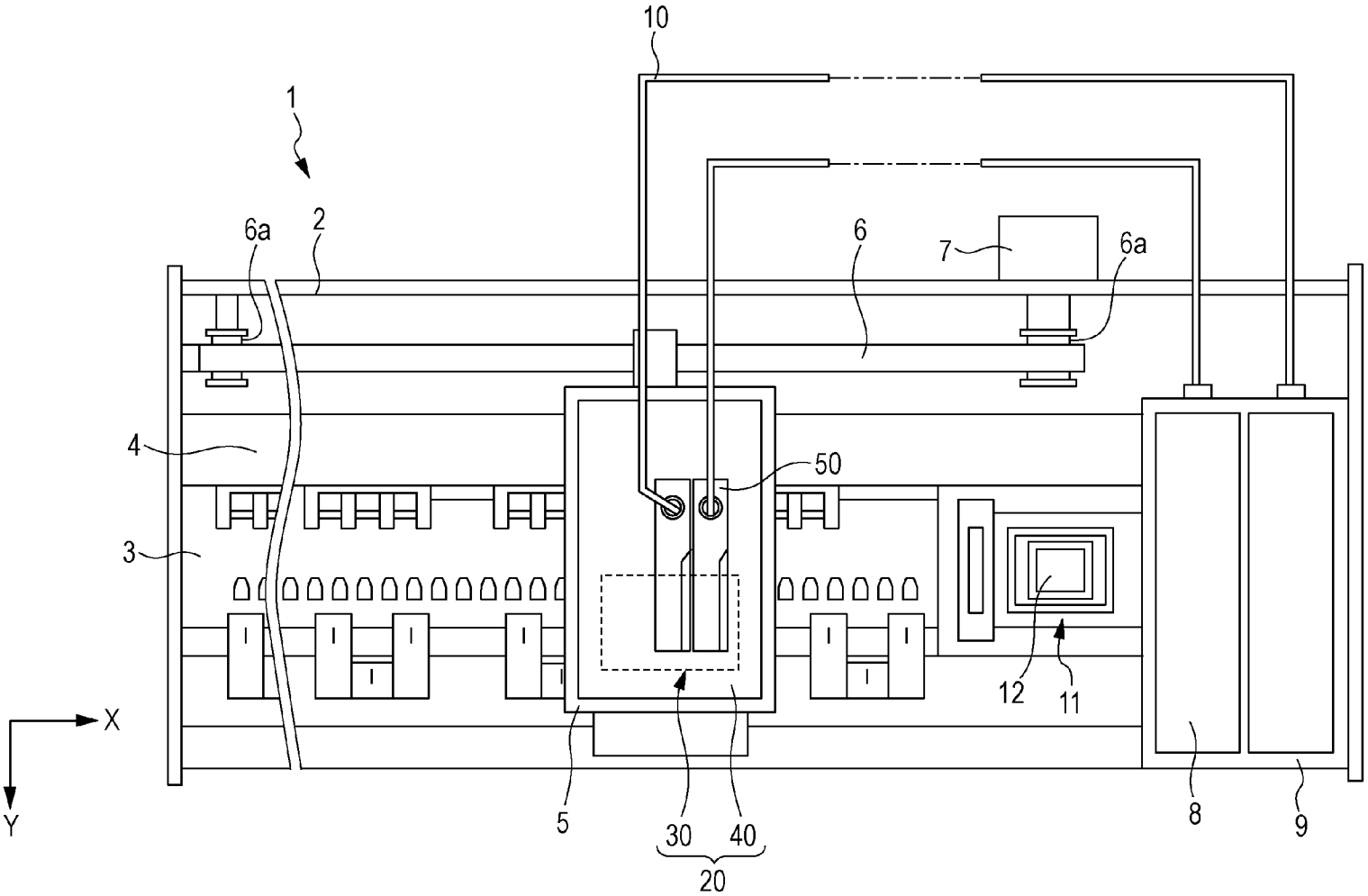
FIG. 1 is a plan view of a recording apparatus according to a first embodiment of the invention.

FIG. 1 is a plan view of an ink jet recording apparatus which is an example of a liquid ejecting apparatus according to a first embodiment of the invention.

As described in FIG. 1, the ink jet recording apparatus 1 includes a main body frame 2 which is a rectangular shape in a plan view. A medium supporting member 3 supporting a medium to be recorded (not illustrated) is provided to be extended along a first direction X which is a main scan direction in the main body frame 2. On the medium supporting member 3, the medium to be recorded such as paper is fed by a sheet feeding mechanism (not illustrated) along a second direction Y which is a sub scan direction perpendicular to the first direction X. In addition, on an upper portion of the medium supporting member 3 in a main body frame 2, a guide shaft 4 in a bar shape which is extended to be parallel with the first direction X of the medium supporting member 3 is provided.

In the guide shaft 4, a carriage 5 is supported in a state of being reciprocally moved along the guide shaft 4 in the first direction X. The carriage 5 is connected to the carriage motor 7 provided in the main body frame 2 through an endless type of a timing belt 6 between a pair of pulleys 6*a* provided in the main body frame 2. Accordingly, the carriage 5 is reciprocally moved along the guide shaft 4 by driving the carriage motor 7.

The carriage 5 includes an ink jet recording head which is an example of the liquid ejecting head 20 of the embodiment (hereinafter, simply referred to as a recording head) and a valve unit 50 which supplies ink from an ink tank 8, which is a liquid storage unit, to the recording head 20.

Although the details will be described later, a plurality of the nozzle openings is provided on a surface of the recording head 20 facing the medium supporting member 3. A pressure generating unit (not illustrated) which is provided in the recording head 20 is driven, whereby landing of dots by the ink droplets, that is, printing is performed by ejecting the ink droplets from each nozzle opening onto the medium to be recorded which is transported onto the medium supporting member 3.

A tank holder 9 is provided on one end of the main body frame 2 in the first direction X, and a plurality of the ink tanks 8 which is the liquid storage unit is detachably mounted on the tank holder 9, respectively. Two ink tanks 8 are provided in the embodiment. In each ink tank 8, each ink having a different type (color) from the other is accommodated.

Each ink tank 8 mounted on the tank holder 9 is connected to the valve unit 50 of the embodiment through the supply pipe 10 such as a tube. The valve unit 50 temporarily stores each color of ink supplied from each ink tank 8 through each supply pipe 10, and the temporally stored inks are respectively supplied to the recording head 20.

In a position near one end portion in the first direction X inside of the main body frame 2, a maintenance unit 11 for performing a maintenance such as cleaning of the recording head 20 is provided on a home position region of the carriage 5. The maintenance unit 11 includes the cap 12 which comes into contact with the recording head 20 so as to surround each nozzle opening of the recording head 20 or accommodates the ink discharged from each nozzle opening by cleaning, and a suction pump (not illustrated) which is able to suck the inside of the cap 12.

In addition, by sucking the inside of the cap 12 with the suction pump (not illustrated) in a state in which the cap 12 comes into contact with the recording head 20 so as to surround each nozzle opening of the recording head 20, a thickened ink, bubbles, or the like are forcibly discharged into the cap 12 from each nozzle opening, and so called cleaning is performed.

Such a recording head 20 mounted in the ink jet recording apparatus 1 will be described with reference to FIG. 2 to FIG. 3B. Moreover, FIG. 2 is a cross sectional view of the ink jet recording head which is an example of the liquid ejecting head according to the first embodiment of the invention and the valve unit, and FIGS. 3A and 3B are cross sectional views of the head main body.

Figure 2:
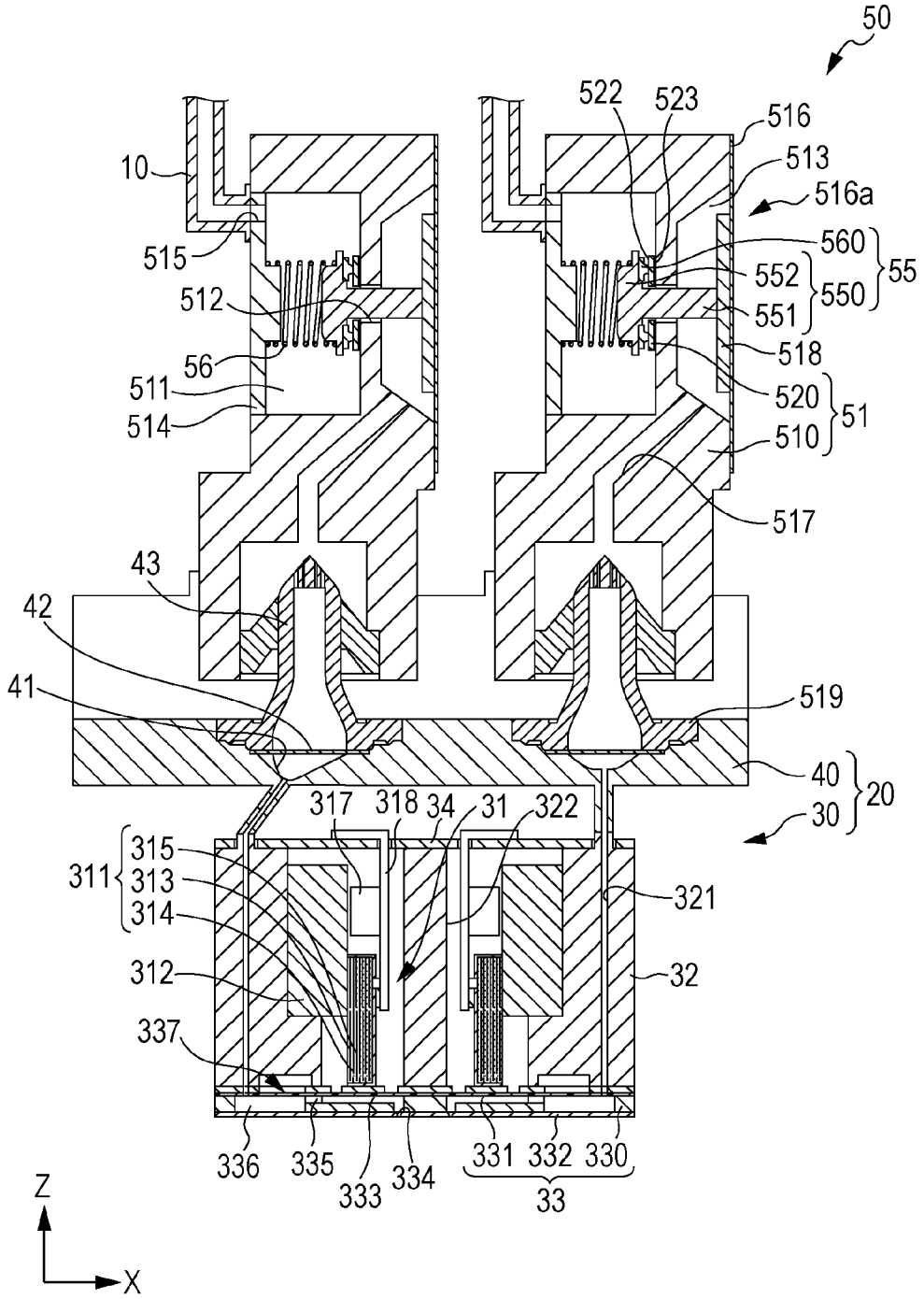
FIG. 2 is a cross sectional view of a recording head and a valve unit according to the first embodiment of the invention.

As illustrated in FIG. 2, the recording head 20 of the embodiment includes a head main body 30 which ejects the ink droplets and a flow passage member 40 which supplies the ink to the head main body 30.

Figure 3A:
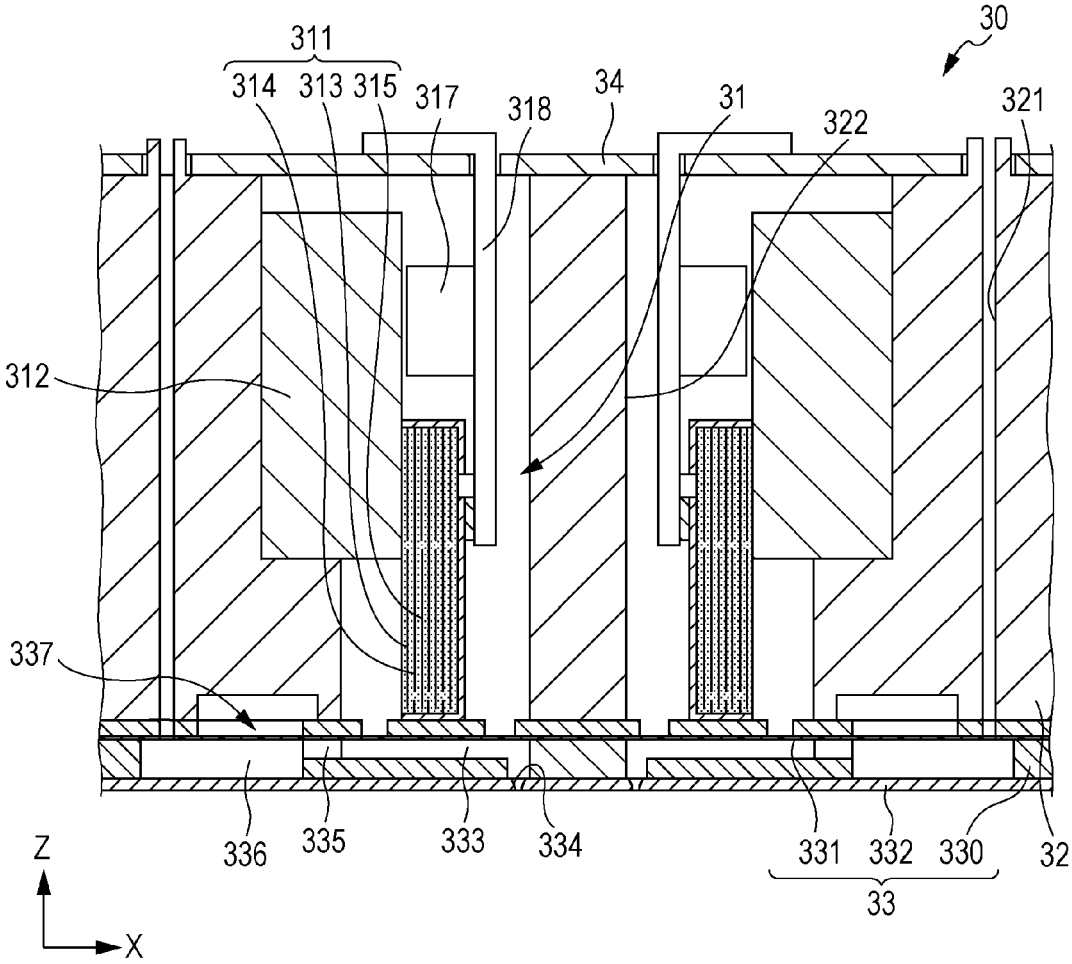
FIGS. 3A and 3B are cross sectional views of a head main body according to the first embodiment of the invention.
Figure 3B:
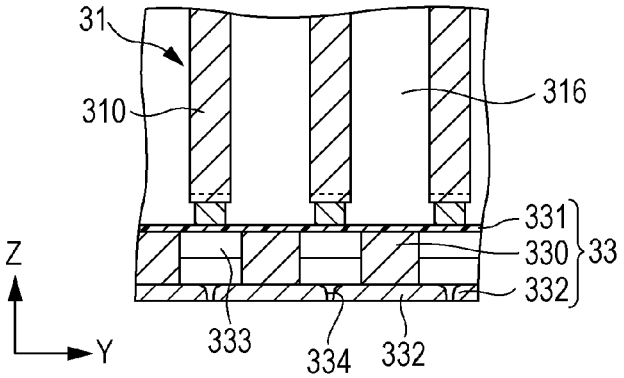

As illustrated FIGS. 3A and 3B, the head main body 30 includes an actuator unit 31, a case 32 which is capable of accommodating the actuator unit 31 therein, a flow passage unit 33 which is bonded to one surface of the case 32, and a wiring substrate 34 which is fixed to the other surface of the case 32.

The actuator unit 31 of the embodiment includes a piezoelectric actuator forming member 311 in which a plurality of the piezoelectric actuators 310 is arranged in parallel along a juxtaposed direction of the nozzle opening 334, and a fixing plate 312 which is bonded with a base end portion (the other end portion) thereof as a fixing end so that a distal portion (one end portion) of the piezoelectric actuator forming member 311 becomes a free end portion.

The piezoelectric actuator forming member 311 is formed by stacking a piezoelectric material 313 with electrode forming materials 314 and 315 in an alternatively pinched state.

In the piezoelectric actuator forming member 311, for example, a plurality of slits 316 is formed by a wire saw, or the like, and the piezoelectric actuator 310 is arranged in parallel by dividing the distal portion thereof in a comb-tooth shape. In the embodiment, the juxtaposed direction of the piezoelectric actuator 310 is a juxtaposed direction of the nozzle opening 334, and the piezoelectric actuator is disposed in the first direction X when being mounted the above described ink jet recording apparatus 1. Accordingly, hereinafter, the juxtaposed direction of the nozzle opening 334 is referred to as the first direction X, and a direction perpendicular to the first direction X is referred to as a second direction Y which is the same as that of the ink jet recording apparatus 1. Of course, when the recording head 20 is mounted in the ink jet recording apparatus 1, the juxtaposed direction of the nozzle opening 334 may not be integral with the first direction X, and it is not particularly limited thereto.

Here, a region bonded with the piezoelectric actuator 310 of the fixing plate 312 is a non-active region where a vibration is not transmitted. When voltage is applied between the electrode forming materials 314 and 315 constituting the piezoelectric actuator 310, only a region of the distal portion to which the fixing plate 312 is not bonded vibrates. The distal portion of the piezoelectric actuator 310 is fixed to the vibration plate 331 to be described later.

In addition, a circuit substrate 318 such as COF in which a driving circuit 317 such as a driving IC for driving the piezoelectric actuator 310 is mounted is connected to each piezoelectric actuator 310 of the actuator unit 31.

The flow passage unit 33 includes a flow passage forming substrate 330, a vibration plate 331, and a nozzle plate 332.

In the flow passage forming substrate 330, a plurality of pressure generating chambers 333 is arranged in parallel, both sides of the flow passage forming substrate 330 are sealed by the nozzle plate 332 which includes the nozzle opening 334 corresponding to each pressure generating chamber 333 and the vibration plate 331. In the embodiment, two rows of the pressure generating chambers 333 which are arranged in parallel are provided. In addition, in the flow passage forming substrate 330, a manifold 336 which is a common ink chamber of the plurality of pressure generating chambers 333 is formed in each row communicating with each pressure generating chamber 333 through each ink supply passage 335. That is, in the embodiment, the manifold 336 is formed in each row of the pressure generating chamber 333.

The distal portion of the piezoelectric actuator 310 is fixed to each region of the vibration plate of the flow passage forming substrate 330 facing each pressure generating chamber 333.

In addition, a compliance portion 337 is provided on a region of the vibration plate 331 corresponding to the manifold 336. Moreover, when a pressure change is generated in the manifold 336, the compliance portion 337 absorbs the pressure change by deforming the compliance portion 337 and always maintains pressure in the manifold 336 constantly.

The case 32 is bonded to the flow passage unit 33, and is provided with the ink introduction passage 321 which supplies the ink from the valve unit 50 connected to the ink tank 8 to the manifold 336. In the embodiment, total two ink introduction passages 321 in which one of the ink introduction passages 321 with respect to each manifold 336 are provided. The ink supplied from the ink tank 8 to the ink introduction passage 321 through the valve unit 50 is supplied to the manifold 336 and distributed to each pressure generating chamber 333 through the ink supply passage 335.

In addition, in the case 32, an accommodation portion 322 is provided to be corresponded to a row of the pressure generating chamber 333. That is, in the embodiment, two accommodation portions 322 are provided, and the actuator unit 31 is fixed into each accommodation portion 322.

Further, the wiring substrate 34 is provided on an opposite side of the flow passage unit 33 in the case 32, and the other end portion of the circuit substrate 318 in which one end thereof is connected to the actuator unit 31 is connected to the wiring substrate 34.

In the head main body 30, the ink droplets are discharged from a predetermined nozzle opening 334 by changing volume of each pressure generating chamber 333 due to a deformation the piezoelectric actuator 310 and the vibration plate 331.

In addition, as illustrated in FIG. 2, one surface of the flow passage member 40 is fixed to the valve unit 50, and the ink is supplied to the head main body 30 fixed to the other surface of the flow passage member 40 from the valve unit 50.

Specifically, an ink communication passage 41 is provided in the flow passage member 40. In one surface of the ink communication passage 41 which is opened, a filter 42 which removes foreign materials such as dust or bubbles contained in the ink, and a supply needle 43 which is provided on the filter 42 are provided.

The supply needle 43 is inserted in the valve unit 50 to be described later. The ink from the valve unit 50 is supplied to the head main body 30 through the ink communication passage 41 after the ink is passed through the inside of the supply needle 43 and foreign materials are removed by filter 42.

The valve unit which is connected to the flow passage member 40 and supplies the ink from the ink tank to the recording head will be described with reference to FIG. 4A to FIG. 5. Moreover, FIG. 4A to FIG. 5 are enlarged cross sectional views of a main part of the valve unit.

In the embodiment, as illustrated in FIG. 2, since two different kinds of ink are supplied with respect to one recording head 20, two valve units 50 are fixed to the flow passage member 40.

Figure 4A:
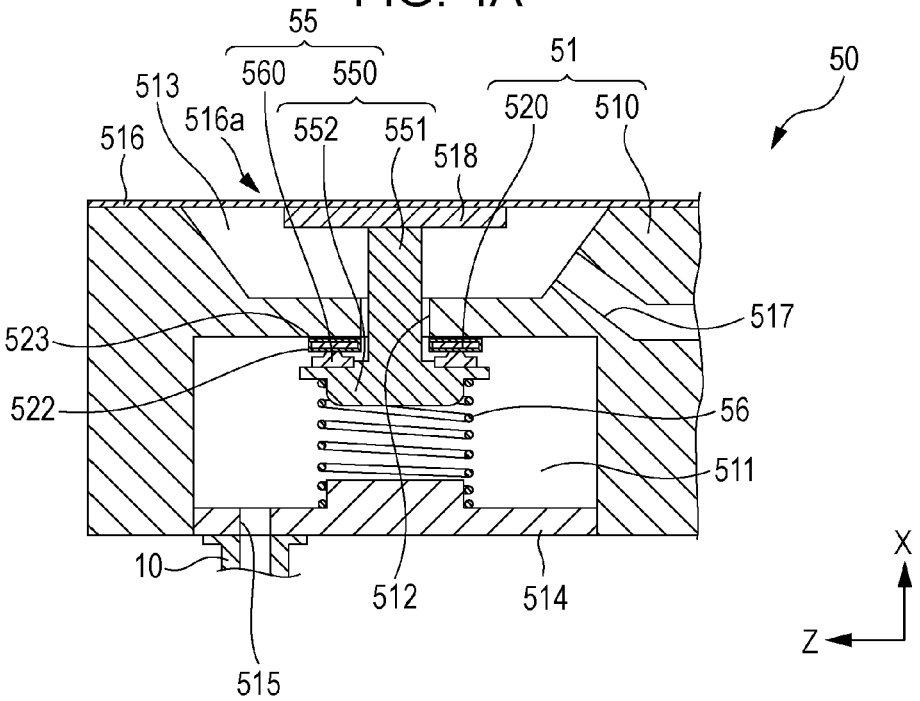
FIGS. 4A and 4B are main part sectional views of the valve unit according to the first embodiment of the invention.
Figure 4B:
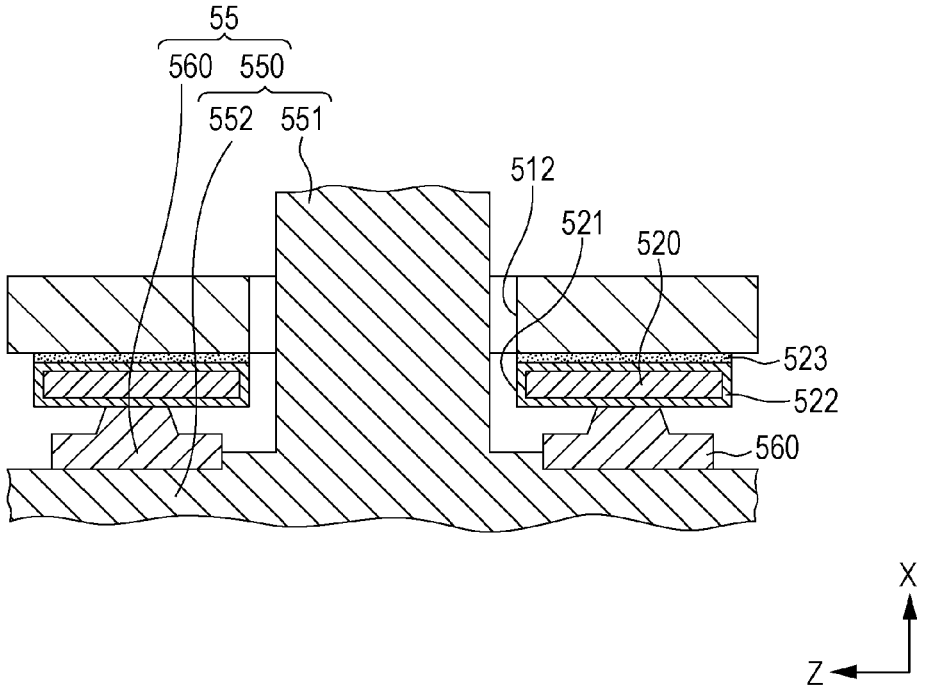
Figure 5:
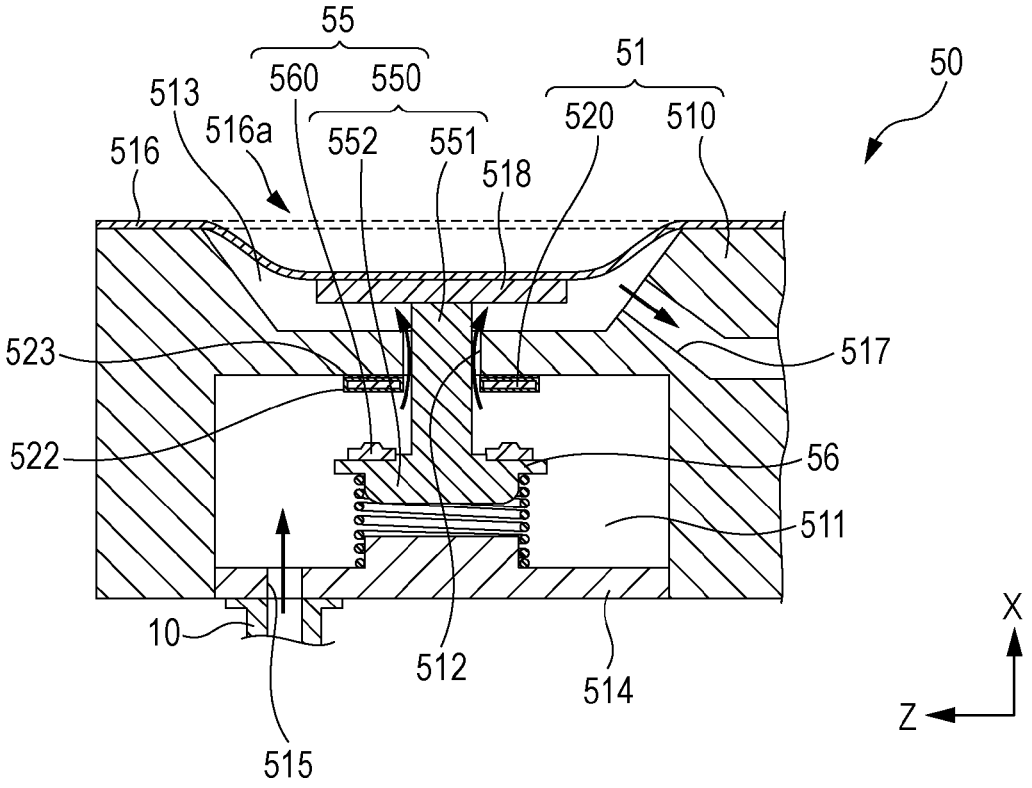
FIG. 5 is a main part sectional view of the valve unit according to the first embodiment of the invention.

As illustrated in FIG. 2 and FIGS. 4A and 4B, each valve unit 50 is a valve which provided in the middle of the flow passage where the ink flows and opens and closes the flow passage. Specifically, the valve unit 50 of the embodiment includes a valve seat 51 and a valve body 55.

The valve seat 51 includes a supporting member 510 and a contacting member 520 which is fixed to a supporting member 510.

The supporting member 510 includes an accommodation chamber 511 which supplies the ink from the ink tank 8 by communicating with the ink tank 8 through the supply pipe 10, and a pressure adjusting chamber 513 which communicates to the ink communication passage 41 of the recording head 20 while communicating the accommodation chamber 511 through an inflow port 512.

The accommodation chamber 511 is formed by sealing the concave portion formed on one surface of the supporting member 510 with a lid member 514. In addition, one end of an inflow passage 515 is formed to be communicated on the accommodation chamber 511. The ink tank 8 is connected to the other end of the inflow passage 515 through the supply pipe 10.

The pressure adjusting chamber 513 has a concave shape which is opened to a side of the supporting member 510 opposite to the accommodation chamber 511. In addition, the film 516 adheres to an opened surface of the pressure adjusting chamber 513 of the supporting member 510, and an opening of the pressure adjusting chamber 513 is sealed by the film 516. In addition, one end of the outflow passage 517 is communicated to the pressure adjusting chamber 513, and the ink communication passage 41 of the recording head 20 is connected to the other end of the outflow passage 517. Moreover, the sealing member 519 is provided on the other end portion in opposite side of one end portion of the outflow passage 517 which is communicated with the pressure adjusting chamber 513. The supply needle 43 of the flow passage member 40 is inserted in the sealing member 519 and connected to the outflow passage 517.

Here, as the film 516, a flexible material having a resistance to liquid can be used. In addition, as the film 516, a material having low gas permeability such as moisture permeability, liquid oxygen, or nitrogen are preferable to use. As a material of the film 516, for example, a configuration is exemplified in which a nylon film which is coated with a vinylidene chloride (saran) is laminated on a high density polyethylene film or a polypropylene (PP) film by adhering. In addition, as other materials, polyethylene terephthalate (PET), or the like may be used. In addition, a bonding method of the film 516 is not limited, and thermal fixing, vibration welding, adhering with an adhesive, or the like can be used.

A part constituting a part of a wall surface of the pressure adjusting chamber 513 of the film 516 is a diaphragm 516*a*. In addition, the pressure receiving plate 518 is provided on a surface of the pressure adjusting chamber 513 of the diaphragm 516*a*. The pressure receiving plate 518 has an exterior in a disc shape smaller than the diaphragm 516*a*. The pressure receiving plate 518 is provided for avoiding such that the valve body 55 which opens and closes the inflow port 512 comes into directly contact with the film 516, and a material having rigidity higher than the diaphragm 516*a*, for example, resin or metal, can be used as a material of the pressure receiving plate.

In a bottom surface of the pressure adjusting chamber 513, that is, in the wall surface facing the diaphragm 516*a* of the supporting member 510, the inflow port 512 which communicates the pressure adjusting chamber 513 and the accommodation chamber 511 by penetrating in a thickness direction is provided. The ink from the accommodation chamber 511 is flowed to the pressure adjusting chamber 513 through the inflow port 512.

The contacting member 520 is provided on peripheries of the opening of the accommodation chamber 511 of the inflow port 512. Here, the contacting member 520 is formed separately from the supporting member 510, and is fixed to the supporting member 510.

The contacting member 520 is formed of a plate-like member in which the communication port 521 communicating with the inflow port 512 is provided. A water repellent treatment having water repellency higher than the water repellency of a flow passage of the supporting member 510, that is, than an inner surface of the pressure adjusting chamber 513 or the accommodation chamber 511, is performed on the surface of the contacting member 520. Here, a supporting member 510 has a complex shape in which the pressure adjusting chamber 513, the accommodation chamber 511, the inflow port 512, and the like, are included, but it is possible to be formed easily and at low costs by being made of, for example, a resin material. Of course, the supporting member 510 may be formed by a metal material, a ceramic, or the like.

On a surface of the contacting member 520, the water repellent treatment having the water repellency higher than the supporting member 510 made of the resin material of the embodiment is performed thereon, so that the water repellent film 522 having the water repellency is formed. Here, the water repellent film 522 is not limited as long as a film has liquid repellency (water repellency) to the ink, and for example, a metal film containing fluorine based polymer, a molecular film of metal alkoxide having the liquid repellent, or the like can be used.

Moreover, the water repellent film 522 made of a metal film containing a fluorine based polymer can be directly formed by performing a eutectoid plating, for example, on the surface of the contacting member 520. In addition, when the molecular film of metal alkoxide is used as the water repellent film 522, for example, a base film made of a plasma polymerized film is provided on the contacting member 520, thereby making it possible to improve adhesion of the water repellent film 522 which is made of the molecular film and the contacting member 520. Moreover, the base film made of the plasma polymerized film can be made by, for example, polymerizing silicone using argon plasma gas. In addition, in the water repellent film 522 made of the molecular film of metal alkoxide, for example, the molecular film can be formed which is polymerized the metal alkoxide by forming metal alkoxide solution by mixing a silane coupling agent such as alkoxysilane with a solvent such as thinner, and immersing the contacting member 520 to the metal alkoxide solution. As the water repellent film 522, when the molecular film of metal alkoxide is used, even though a base layer is provided, there are advantages that the film thinner than the water repellent film 522 made of the metal film which includes the fluorine based polymer formed by the electrolytic plating can be formed, and "abrasion resistant" which deteriorates the water repellency with difficulty even though the valve body 55 comes into contact and the water repellency can be improved. Also, even though "abrasion resistant" and "liquid repellency" deteriorate, the water repellent film 522 made of the metal film containing the fluorine based polymer can be used.

In addition, the material of the contacting member 520 in which the water repellent film 522 is provided is not limited, and for example, a resin material, a metal material such as a stainless steel (SUS), a glass ceramic, a silicon single crystal substrate, or the like can be used. However, by using the metal material such as the stainless steel (SUS) as the contacting member 520, swelling of the contacting member 520 by the ink is suppressed and a sealing ability can be certainly maintained by the contact with the valve body 55. That is, as the contacting member 520, when a material which swells by the ink is used, swelling of the contacting member 520 by the ink does not uniformly occur in a circumferential direction of the inflow port 512, and unevenness is generated in a swelling amount. Accordingly, when the valve body 55 comes into contact with the water repellent film 522 of the contacting member 520 and closes the communication port 521, the valve body 55 cannot uniformly adhere along a circumferential direction of the communication port 521, and the sealing ability cannot be maintained, such that a leak of the ink is generated. That is, as the contacting member 520, it is preferable that it is not easy for a material to swell by the ink. In addition, as the contacting member 520, a material is preferable in which rust or corrosion hardly occurs by the ink, and stainless steel can be used appropriately.

In addition, fixing of the contacting member 520 and the supporting member 510 is not particularly limited, and for example, there is adhering by heating or vibrating or adhering by an adhesive. In the embodiment, the contacting member 520 and the supporting member 510 adhere to each other by the adhesive 523. In addition, a region of the contacting member 520 to which the supporting member 510 is fixed is preferably subjected to the water repellent treatment. That is, a region of the contacting member 520 to which the supporting member 510 is fixed is preferably a non water repellent region in which the water repellent film 522 is not provided. Accordingly, by increasing bonding force of the contacting member 520 and the supporting member 510, easy peeling of the contacting member 520 from the supporting member 510 can be suppressed. That is, since the water repellent film 522 (the details thereof will be described later) is provided for suppressing accumulation of the ink by repeatedly coming into contact with the valve body 55, the water repellent film 522 may be provided on only a region of the contacting member 520 with which at least the valve body 55 comes into contact. Moreover, in the embodiment, since the contacting member 520 is provided separately from the supporting member 510, the contacting member 520 can be independently subjected to the water repellent treatment. Accordingly, a water repellent region and a non water repellent region are easily formed on the contacting member 520. Particularly, since the contacting member 520, which is different from the supporting member 510 having a complex shape, has a simple configuration in which the communication port 521 is provided on a plate-like member, it is easy to selectively form the water repellent region. The water repellent film 522 may be formed on a front surface of the contacting member 520. In addition, the contacting member 520 may be fixed to the supporting member 510 by a screw, a clip, or the like, and a fixing method is not particularly limited.

The communication port 521 formed in the contacting member 520 has a diameter which is substantially the same as the inflow port 512 of the supporting member 510. The valve body 55 is inserted into the inflow port 512 of the supporting member 510 and the communication port 521 of the contacting member 520.

The valve body 55 includes the fixing member 550 and the elastic member 560. Here, the fixing member 550 includes the shaft portion 551 which is inserted into the inflow port 512 and the communication port 521 and the flange portion 552 which is provided in an end portion in the accommodation chamber 511 of the shaft portion 551. The elastic member 560 is fixed to the flange portion 552 of the fixing member 550.

The shaft portion 551 has an outer diameter which is slightly smaller than the inflow port 512 and the communication port 521, and one end portion in the pressure adjusting chamber 513 is come into contact with the center portion of the pressure receiving plate 518. In addition, the other end portion of the shaft portion 551 of opposite side which comes into contact with the pressure receiving plate 518 is arranged in the accommodation chamber 511, and the flange portion 552 is formed integrally on the other end portion in the accommodation chamber 511.

The flange portion 552 is a circular plate-like member. In addition, the elastic member 560 is fixed to the flange portion 552. The elastic member 560 has an annular shape made of rubber, elastomer, or the like, and the distal portion thereof protrudes to face the contacting member 520. The elastic member 560 is fixed to a surface of the flange portion 552 on the contacting member 520 side, and the protruded distal portion comes into contact with the water repellent film 522 of the contacting member 520, and therefore, the inflow port 512 and the communication port 521 are closed. Moreover, a fixing method of the elastic member 560 to the fixing member 550 is not particularly limited, and for example, an adhesion method by the adhesive is exemplified. In addition, the elastic member 560 is configured to cover the flange portion 552, and may be insertedly fitted to the flange portion 552. Further, the fixing member 550 and the elastic member 560 are, for example, formed to be integral with each other by a two-color molding method. The fixing member 550 and the elastic member 560 are formed to be integral with each other by the two-color molding method, and therefore, adhering in a state of a position deviation or a disproportionate deforming at the time of adhering the elastic member 560 to the fixing member 550, can be suppressed, and the position deviation by repeated contact between the elastic member 560 and the contacting member 520 can be suppressed. Accordingly, the elastic member 560 and the contacting member 520 stably come into contact with each other, whereby the sealing ability can be improved.

The coil spring 56 is interposed between the flange portion 552 of the valve body 55 and the lid member 514 which define the accommodation chamber 511, and the valve body 55 is urged to the pressure adjusting chamber 513 in a shaft direction of the shaft portion 551 as a moving shaft direction by urging force of the coil spring 56.

Here, as force applied to the valve body 55, there are reaction force of the film 516, force applied to the pressure receiving plate 518 and the diaphragm **516*a* by receiving ink pressure of the pressure adjusting chamber 513, urging force of the coil spring 56, and force applied to the valve body 55** by receiving ink supply pressure.

The reaction force of the film 516 is restoring force of the diaphragm **516*a* which is bent and deformed for restoring a shape thereof to an original shape. As a deformed amount of the diaphragm 516*a*, that is, the bent amount is large, the greater reaction force of the film 516 is. The reaction force of the film 516 is transmitted to the shaft portion 551 through the pressure receiving plate 518**.

The force applied to the pressure receiving plate 518 and the diaphragm **516*a* by receiving the ink pressure of the pressure adjusting chamber 513 is calculated by multiplying receiving area of the pressure receiving plate 518 and the diaphragm 516*a* with the ink pressure. When liquid in the pressure adjusting chamber 513 flows downstream from an outflow passage 517 and the ink in the pressure adjusting chamber 513 decreases, a pressure difference between the ink pressure and the atmosphere pressure increases, and the force applied to the pressure receiving plate 518 and the diaphragm 516*a* increases. The force applied to the pressure receiving plate 518 and the diaphragm 516*a* is operated as force in an opening direction through the shaft portion 551 to the valve body 55**.

The urging force of the coil spring 56 is force urging the valve body 55 in the opening direction. As described above, in the embodiment, since the valve body 55 gives a force, which is applied in opposite direction to the force applied to the pressure receiving plate 518 and the diaphragm **516*a* by the ink pressure of the pressure adjusting chamber 513, to the pressure receiving plate 518 by the coil spring 56, the ink in the pressure adjusting chamber 513 needs to be decompressed to a lower pressure (operating pressure) as much as the urging force of the coil spring 56 for displacing the pressure receiving plate 518 until the valve body 55** reaches an opening position.

In the valve unit 50, as illustrated in FIG. 5, the ink in the pressure adjusting chamber 513 flows downstream and the inside of the pressure adjusting chamber 513 is decompressed with negative pressure, whereby the diaphragm 516*a* is moved to the bottom surface of the pressure adjusting chamber 513, the pressure receiving plate 518 presses the valve body 55 against the urging force of the coil spring 56, and an interval is generated between the elastic member 560 of the valve body 55 and the contacting member 520 so that the inflow port 512 and the communication port 521 are opened. In addition, when the decompression in the pressure adjusting chamber 513 is released by supplying the ink into the pressure adjusting chamber 513 from the accommodation chamber 511 due to the opening, the diaphragm 516*a* returns to the original position by the urging force of the coil spring 56 so that the ports are closed (refer to FIGS. 4A and 4B).

Figure 6A:
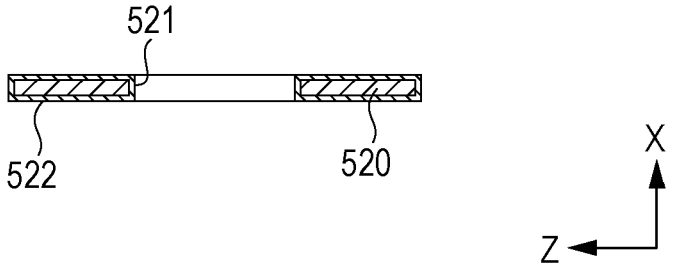
FIGS. 6A and 6B are cross sectional views illustrating a manufacturing method of the valve unit according to the first embodiment of the invention.
Figure 6B:
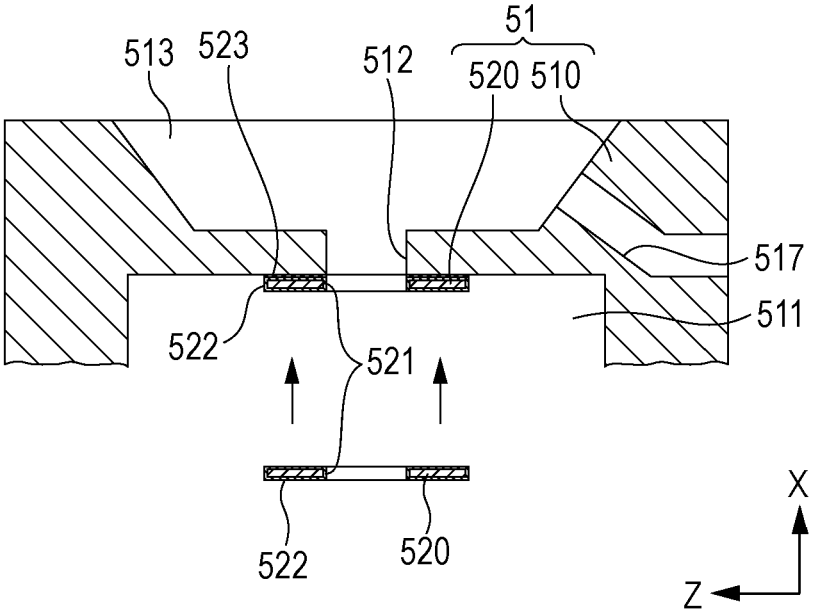

As described above, after performing the water repellent treatment on the contacting member 520, the valve unit 50 is formed by being fixed to the supporting member 510. That is, as described in FIG. 6A, the water repellent treatment is performed on the contacting member 520 in which the communication port 521 is provided, first, so that the water repellent film 522 is formed on the contacting member 520. After that, as illustrated in FIG. 6B, the contacting member 520 in which the water repellent film 522 is formed by performing the water repellent treatment is fixed to the supporting member 510. Then, the valve body 55 and the coil spring 56 are disposed while fixing the film 516 to the supporting member 510, and the accommodation chamber 511 is sealed by the lid member 514, and thereby the valve unit 50 which is illustrated in FIGS. 4A and 4B is manufactured.

Since the contacting member 520 which is subjected to the water repellent treatment is formed separately from the supporting member 510 and fixed to the supporting member 510, it is easy to form the water repellent film 522 by selectively performing the water repellent treatment on only the contacting member 520. With respect that, for example, when the water repellent treatment is directly performed on the supporting member 510 without providing the contacting member 520, it is not easy for the selective water repellent treatment to be sufficiently performed on a region with which the valve body 55 comes into contact. There is a concern that the water repellent treatment is performed on regions other than the region with which the valve body 55 comes into contact by water repellent deterioration or a position deviation. If the water repellent treatment is not sufficiently performed, the contacting member 520 and the valve body 55 are repeatedly brought into contact with each other such that the water repellency decreases for a short time; therefore, the water repellency cannot be maintained for a long time. In the embodiment, since the water repellent treatment is selectively performed on only the contacting member 520, the water repellent film 522 can be formed with sufficient thickness. The water repellency can be maintained for a long time. The accumulation of the ink by the contacting member 520 repeatedly coming into contact with and the valve body 55 can be suppressed for a long time. In addition, when the position deviation is generated in a region on which the water repellent treatment performed, the region with which the valve body 55 comes into contact is not subjected to the water repellent treatment. There is a concern that the accumulation of the ink is generated on the region by repeatedly coming into contact with the valve body 55. In addition, when the water repellent treatment is excessively performed on adhesion region of peripheries, components constituting the flow passage cannot adhere sufficiently to each other; therefore, the ink is leaked from the flow passage or the components are separated from each other. As the embodiment, the contacting member 520 is independently subjected to the water repellent treatment without the position deviation using the contacting member 520 separately formed from the supporting member 510; therefore, there is no configuration in which the water repellent treatment is performed on other regions of the supporting member. Accordingly, water repellency deterioration, a defect due to the position deviation, or the like can be suppressed.

The contacting member 520 with which the valve body 55 comes into contact is subjected to the water repellent treatment, and thereby an accumulation and a growth of the ink on a part in which the valve body 55 and the contacting member 520 are brought into contact with each other can be suppressed. That is, when the contacting member 520 is not subjected to the water repellent treatment, the ink is accumulated and grown on the contacting member 520 by repeatedly coming into contact with the valve body 55, and thereby the valve is not completely closed and the ink is leaked. In the embodiment, by performing the water repellent treatment on the contacting member 520, the ink is difficult to be accumulated on the contacting member 520 and the leak of ink can be suppressed by suppressing the growth of the ink.

Other Embodiments

Hereinabove, one embodiment of the invention is described; however, a basic configuration of the invention is not limited to the above description.

For example, in the above described first embodiment, the contacting member 520 is subjected to the water repellent treatment so as to form the water repellent film 522; however, it is not particularly limited thereto, and the contacting member 520 itself may be formed of a material having the water repellency to the ink. In addition, the water repellency may given by performing a plasma process on a surface of the contacting member 520. That is, a state in which the contacting member 520 is subjected to the water repellent treatment includes a state in which the contacting member 520 itself is formed of a material having the water repellency and a state in which a surface of material having a low water repellency is subjected to the water repellent treatment.

In addition, in the first embodiment, the elastic member 560 of the valve body 55 comes into contact with the contacting member 520; however, it is not limited thereto, and the elastic member 560 may come into contact with both of the contacting member 520 and the supporting member 510.

In addition, in the first embodiment, the contacting member 520 which is subjected to the water repellent treatment is provided on the supporting member 510; however, it is not particularly limited thereto, the contacting member 520 may be provided on the valve body 55, and the elastic member 560 may be provided on the supporting member 510. In this case, a valve body in Claims corresponds to the supporting member 510, and a valve seat in Claims corresponds to the valve body 55.

Further, in the first embodiment, as a pressure generating unit which generates a pressure change in the pressure generating chamber 333, the piezoelectric actuator 310 is used to describe in which a piezoelectric material 313 and electrode forming materials 314 and 315 are alternately stacked and extended and contracted in a shaft direction; however, as the pressure generating unit, it is not particularly limited thereto, and for example, a bending vibration type piezoelectric actuator is used for description such as a thin film type piezoelectric actuator in which electrodes and piezoelectric materials are stacked by a film forming method and a lithography method, a thick film type piezoelectric actuator which is formed by a method adhering green sheet, or the like. In addition, as the pressure generating unit, a so called electrostatic actuator can be used such as an actuator which discharges liquid droplets from the nozzle opening by bubbles generated due to heating of a heat element which is disposed in a pressure generating chamber, an actuator which discharges liquid droplets from the nozzle opening by deforming the vibration plate by generating electrostatic force between the vibration plate and the electrode, or the like.

In addition, in the above described ink jet recording apparatus 1, it is exemplified that the recording head 20 is mounted on the carriage 5 and moves in the first direction X; however, it is not particularly limited thereto, and for example, the invention can be applied to a so called line type recording apparatus which performs printing by fixing the recording head 20 and moving the medium to be recorded in the second direction Y.

In addition, the above described ink jet recording apparatus 1 has a configuration in which the ink tank 8 which is a liquid storage unit is mounted on the tank holder 9 of the main body frame 2, but it is not particularly limited thereto, and the ink cartridge which is a liquid storage unit may be mounted on the carriage 5. In addition, the valve unit 50 is not limited to being mounted on the carriage 5, and the valve unit 50 and the recording head 20 may be connected to each other through the supply pipe such as a tube.

Further, the invention aims to applied to all liquid ejecting apparatuses which include a wide liquid ejecting head, and for example, it can be used in various liquid ejecting apparatuses including a recording head such as an ink jet recording head used in an image recording apparatus such as a printer, a color material ejecting head for manufacturing a color filter such as a liquid crystal display, an electrode forming ejecting head for manufacturing electrodes such as an organic EL display or a field emission display (FED), a bio organic material ejecting head for manufacturing a biochip, or the like.

What is claimed is:

1. A liquid ejecting apparatus comprising:

a liquid ejecting head that includes a nozzle opening which ejects liquid; and a valve unit that is connected to the liquid ejecting head and opens and closes a flow passage of the liquid, wherein the valve unit includes a valve seat which is provided in the flow passage and a valve body which opens and closes the flow passage by coming into contact with or being separated from the valve seat, wherein the valve seat includes a contacting member coming into contact with the valve body and a supporting member which supports the contacting member, wherein the contacting member is formed separately from the supporting member and is subjected to a water repellent treatment more than the inner surface of the flow passage, wherein the contacting member is attached to the supporting member by an attaching member, and wherein the valve body includes an elastic member coming into contact with the valve seat and a fixing member which fixes the elastic member.

2. The liquid ejecting apparatus according to claim 1, wherein the contacting member is formed of a metal material.

3. The liquid ejecting apparatus according to claim 1, wherein the elastic member and the fixing member are formed by a two-color molding method.

4. A manufacturing method of a liquid ejecting apparatus which includes a liquid ejecting head that includes a nozzle opening which ejects liquid, and a valve unit that is connected to the liquid ejecting head and opens and closes a flow passage of the liquid, in which the valve unit includes a valve seat which is provided in the flow passage and a valve body which opens and closes the flow passage by coming into contact with or separated from the valve seat, the valve seat includes a contacting member coming into contact with the valve body and a supporting member which supports the contacting member, wherein the contacting member is formed separately from the supporting member, and the valve body includes an elastic member coming into contact with the valve seat and a fixing member which fixes the elastic member, the method comprising:

performing a water repellent treatment on the contacting member more than the inner surface of the flow passage and attaching the contacting member to the supporting member with an attaching member.

* * * * *